US006555770B2

(12) United States Patent
Kawase

(10) Patent No.: US 6,555,770 B2
(45) Date of Patent: Apr. 29, 2003

(54) COMPOSITE OPERATION SWITCH

(75) Inventor: Tatsuaki Kawase, Miyagi-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 49 days.

(21) Appl. No.: 09/873,140

(22) Filed: Jun. 1, 2001

(65) Prior Publication Data

US 2002/0003081 A1 Jan. 10, 2002

(30) Foreign Application Priority Data

Jul. 6, 2000 (JP) ..... 2000-210699

(51) Int. Cl.[7] ..... H01H 9/00
(52) U.S. Cl. ..... 200/18
(58) Field of Search ..... 200/4, 18, 5 A, 200/5 B, 7

(56) References Cited

U.S. PATENT DOCUMENTS 5,607,611 A * 3/1997 Lee ..... 200/5 B X
5,821,480 A * 10/1998 Machida ..... 200/4
5,847,335 A 12/1998 Sugahara et al. ..... 200/4
5,945,647 A * 8/1999 Hoskins ..... 200/18

* cited by examiner

*Primary Examiner*—Renee Luebke
(74) *Attorney, Agent, or Firm*—Beyer Weaver & Thomas, LLP

(57) ABSTRACT

The present invention provides a composite operation switch that provides for more functions without increasing the number of switches and expanding its size, and provides satisfactory operability for switch selection operation. The composite operation switch includes: a housing that has a hollow ring-shape area and is provided with fixed contacts on an inside bottom face of the ring-shape area; a first rotor that is rotatably mounted in the housing and provided with movable contacts, which, upon rotation, contact or separate from the fixed contacts; a second rotor that is mounted in the first rotor and rotates together with the first rotor; and a multi-direction operation switch placed inside the hollow ring-shape area of the housing, wherein the second rotor is mounted in the first rotor so as to be vertically movable, and in the vicinity of the housing, a detecting switch is provided that detects a vertical movement position of the second rotor and outputs a signal for switching the types of selection functions of the multi-direction operation switch.

5 Claims, 4 Drawing Sheets

COMPOSITE OPERATION SWITCH

BACKGROUND OF THE INVENTION

1. Field of the Invention

The present invention relates to a composite operation switch, and more particularly to the structure of a composite operation switch providing for many functions that is used with various electronic equipment for home use and vehicle use.

2. Description of the Prior Art

As operation switches of various equipment for home use and vehicle use, composite operation switches with many switch functions are used. According to a generally known structure of the conventional composite operation switches, a hollow ring-shape rotary switch is placed outside, and a multi-direction operation switch comprising a four-direction inclination switch and a push switch is placed inside the hollow area.

In the conventional composite operation switches, the rotary switch placed outside comprises a hollow ring-shape housing and a rotor rotatably disposed within the housing. The housing is made of an insulating material such as synthetic resin, and fixed contacts made of a conductive metallic material are disposed on the inside bottom face of the housing. To the rotor, movable contacts made of a conductive metallic material are fixed in opposed relation to the fixed contacts, and as the rotor rotates, the movable contacts move in contact on the fixed contacts, whereby contact switching is performed.

The multi-direction operation switch placed inside the hollow area comprises a housing having an internal storing part formed in box shape and a slide member stored so as to be vertically slidable and tiltably supported in the storing part of the housing. The housing is made of an insulating material such as synthetic resin, and plural fixed contacts are disposed on the inside bottom face of the housing. The plural fixed contacts include a central fixed contact operated when the slide member is pushed, and peripheral fixed contacts operated in the respective operation directions when the slide member is inclined in four directions.

On the above-described plural fixed contacts, domed movable contacts made of a conductive metallic material are respectively disposed in opposed relation to the fixed contacts. The plural movable contacts include a central movable contact pushed and connected to the central fixed contact when the slide member is pushed, and peripheral movable contacts pushed and connected to the peripheral fixed contacts when the slide member is tilted in four directions.

The rotary switch and the multi-direction operation switch are integrally fitted to a frame of electronic equipment or the like and a circuit board. A hollow rotation operation knob is fitted to the tip of the rotor of the rotary switch, and an inclination operation knob fitted in the slide member of the multi-direction operation switch is placed in the center of the rotation operation knob, constituting an integral composite operation switch.

According to the composite operation switches, this one switch provides plural switch functions of a push switch, a four-direction inclination switch, and a rotation pulse switch.

However, since the respective switches of the above described conventional composite switches have only a single function, if more selection functions are required, more switches must be provided, posing the problem that if the hollow area of the rotary switch is expanded as switches increase, the switch will increase in size.

In this case, since many switches are placed on a plane, there has been a possibility that malfunction may occur due to the user's mistaken press during switch selection operation.

SUMMARY OF THE INVENTION

Therefore, the present invention provides a composite operation switch that solves the above-described problems, provides for more functions without increasing the number of switches and expanding its size, and provides satisfactory operability for switch selection operation.

To solve the above-described problems, as first means, the present invention provides a composite operation switch that includes: a housing that has a hollow ring-shape area and is provided with fixed contacts on an inside bottom face of the ring-shape area; a first rotor that is rotatably mounted in the housing and provided with movable contacts, which, upon rotation, contact or separate from the fixed contacts; a second rotor that is mounted in the first rotor and rotates together with the first rotor; and a multi-direction operation switch placed inside the hollow ring-shape area of the housing, wherein the second rotor is mounted in the first rotor so as to be vertically movable, and in the vicinity of the housing, a detecting switch is provided that detects a vertical movement position of the second rotor and outputs a signal for switching the types of selection functions of the multi-direction operation switch.

As second means, the first rotor is provided with up-and-down guide parts engaged with the second rotor; and by the up-and-down guide parts, the second rotor is disposed outside the first rotor so as to be vertically movable, the second rotor is fitted in the first rotor so that they rotate at the same time, and the first and second rotors are integrally mounted rotatably in the housing.

As third means, the first rotor is provided with convex cam parts, the second rotor is provided with elastic members engaging with the convex cam parts, and when the second rotor ascends or descends, the elastic members move across the cam parts.

As fourth means, a parallel link mechanism for controlling vertical movement of the second rotor is provided between the first rotor and the second rotor.

As fifth means, the multi-direction operation switch is a four-direction inclination switch with a center push switch.

BRIEF DESCRIPTION OF THE DRAWINGS

Preferred embodiments of the present invention will be described in detail based on the followings, wherein.

DESCRIPTION OF THE PREFERRED EMBODIMENTS

Figure 1:
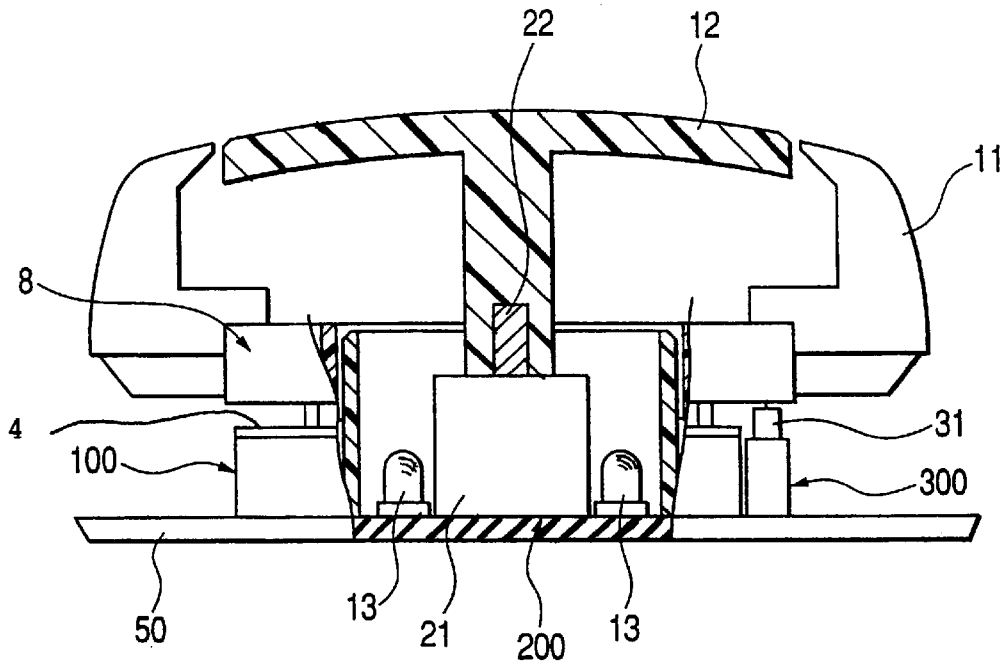
FIG. 1 is a sectional view of a part of a composite operation switch fitted with an operation knob of one embodiment example of the present invention.
Figure 2:
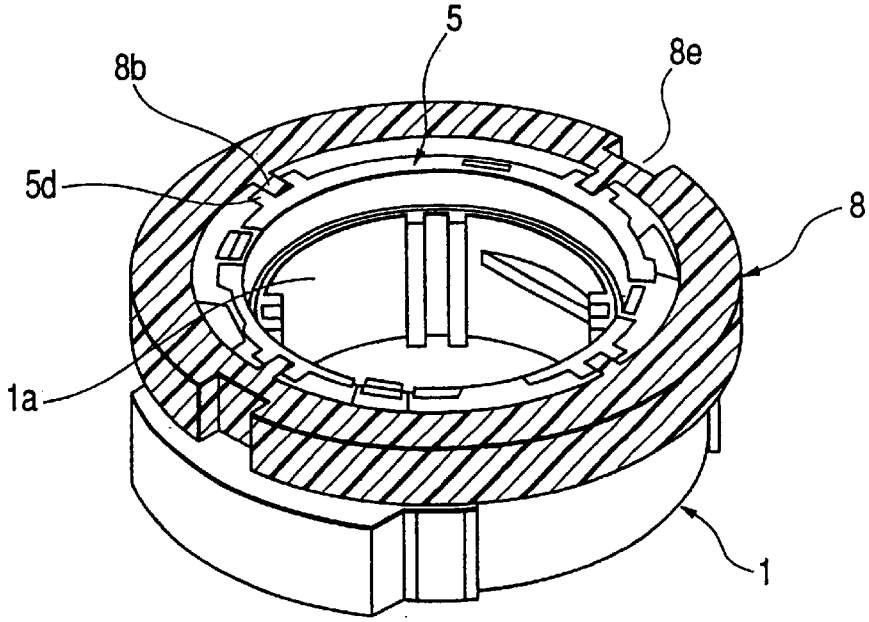
FIG. 2 is a perspective view showing the composite operation switch of the present invention.
Figure 3:
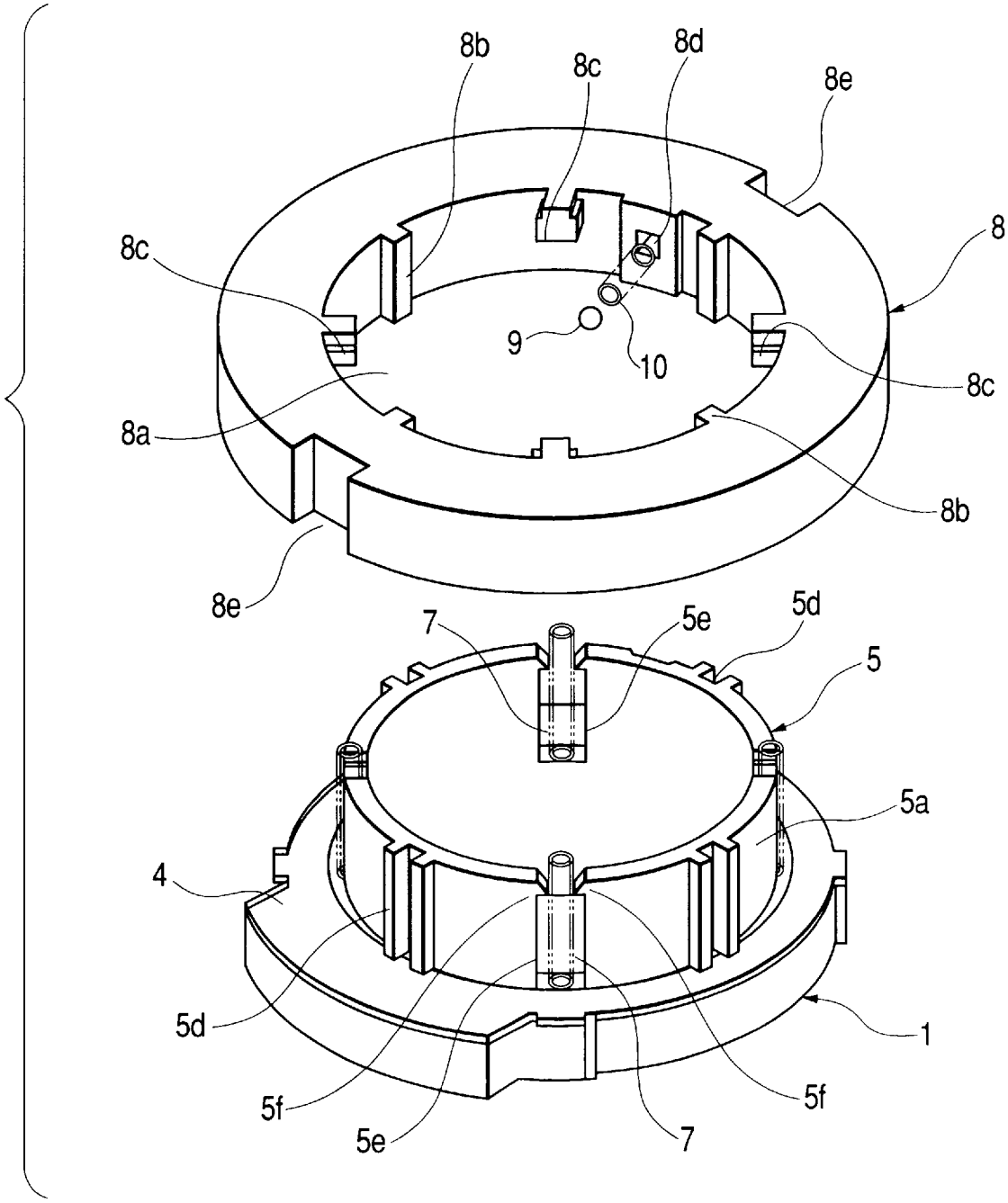
FIG. 3 is an exploded perspective view of a first rotor from which a second rotor is removed.
Figure 4:
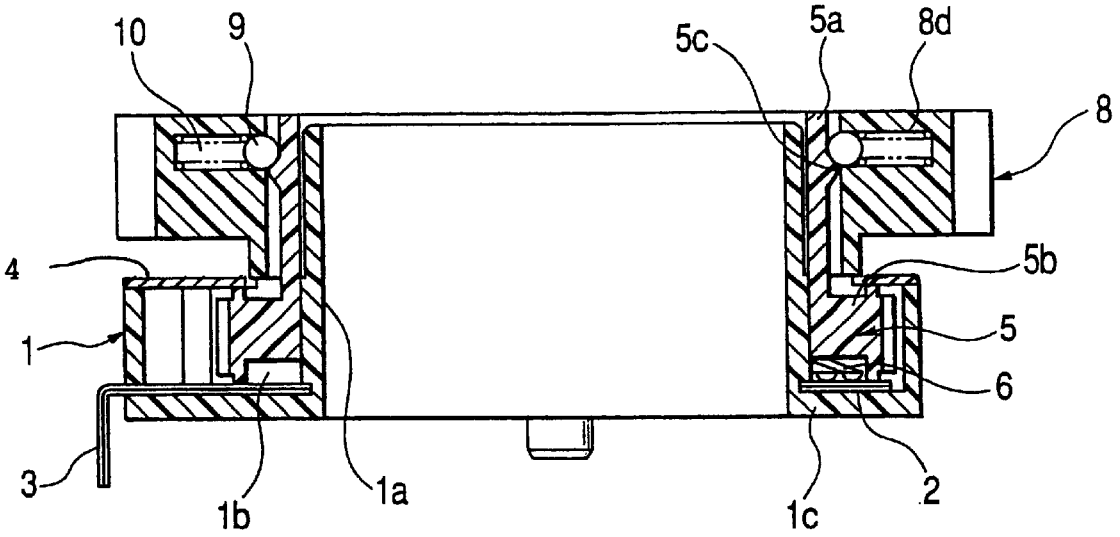
FIG. 4 is a sectional view of the first rotor when the second rotor ascends.
Figure 5:
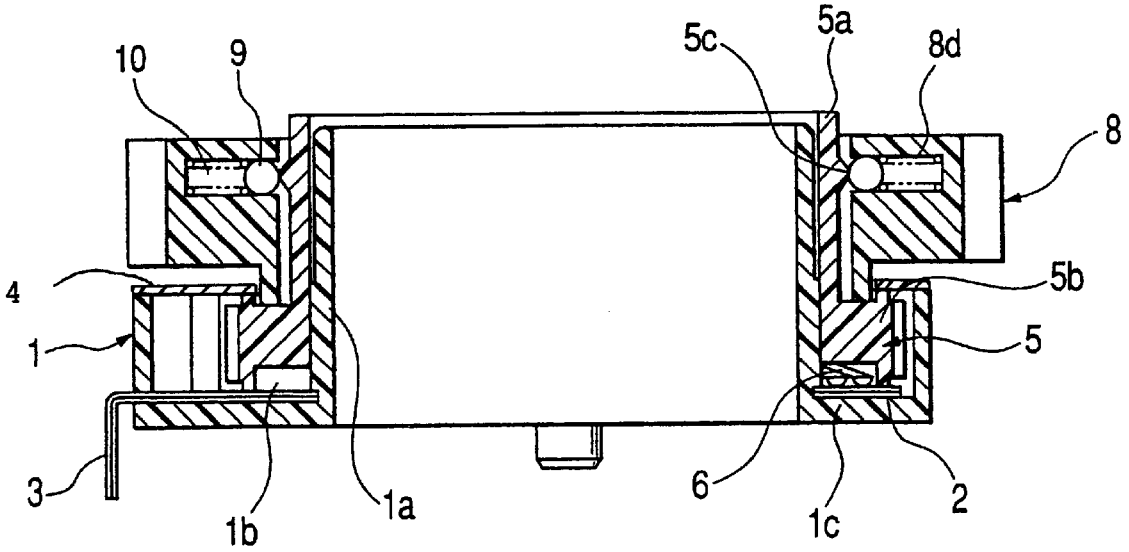
FIG. 5 is a sectional view of the first rotor when the second rotor descends.
Figure 6:
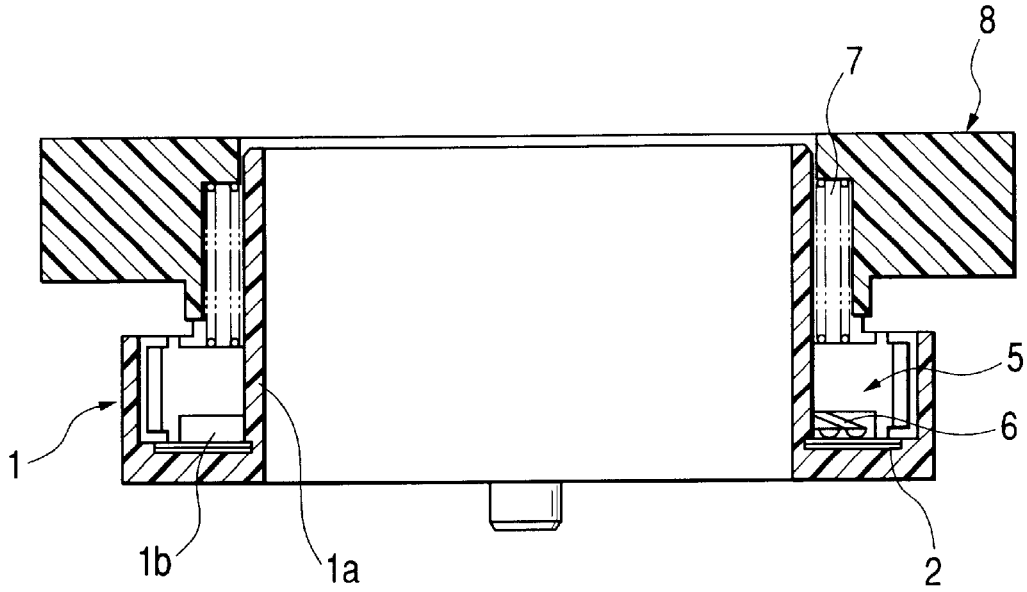
FIG. 6 is a sectional view showing the placement of a return spring of the second rotor.

Hereinafter, one embodiment example of the present invention will be described with reference to the accompanying drawings FIGS. 1 to 7. FIG. 1 is a sectional view of a part of a composite operation switch fitted with an operation knob; FIG. 2, a perspective view showing the composite operation switch; FIG. 3, an exploded perspective view of a first rotor from which a second rotor is removed; FIG. 4, a sectional view of the first rotor when the second rotor ascends; FIG. 5, a sectional view of the descending second rotor; FIG. 6, a sectional view showing the placement of a return spring; and FIG. 7, a sectional view showing the placement of a parallel link mechanism.

In the drawings, a housing 1 is made of an insulating material such as synthetic resin and has a hollow ring-shape area at the center thereof. A hollow, cylindrical supporting shaft part 1*a* is provided at the center of the housing 1, and a basement part 1*c* having a ring-shape storing part 1*b* with an open upper face is provided at a lower end of the supporting shaft part 1*a*. On the inside bottom face of the storing part 1*b* of the basement part 1*c*, fixed contacts 2 made of a conductive material are disposed in ring shape along the inside bottom face thereof. The basement part 1*c* has an extensionally disposed connecting terminal 3, connected between the fixed contacts 2 and the basement part 1*c*, that is derived out of the basement part 1*c*. A cover 4, constructed from a metallic plate, is mounted to cover the opening of the ring-shape storing part 1*b*.

A first rotor 5 is made of an insulating material such as synthetic resin and has a hollow ring-shape area at the center thereof. The first rotor 5 has a cylindrical rotary shaft part 5*a* which is inserted in the supporting shaft part 1*a* of the housing 1 and engaged rotatably about the supporting shaft part 1*a*. At a lower end of the rotary shaft part 5*a*, a cylindrical rotary basement 5*b* rotatably stored in the storing part 1*b* of the basement part 1*c* is provided, and at a lower end of the rotary basement 5*b*, a moving contact 6 with plural slugs provided, made of a conductive metallic material, is fixed which is disposed in opposed relation to the fixed contacts 2 disposed in the storing part 1*b*.

The moving contact 6 slides in contact with the fixed contacts 2 disposed in the storing part 1*b* of the housing 1, thereby forming a contact part of the rotary switch 100.

The first rotor 5 is provided in the outer circumference of the rotary shaft part 5*a* with plural convex cam parts 5*c*, which impart tactile feel when the second rotary 8 described later ascends or descends.

In the outer circumference of the rotary shaft part 5*a*, plural concave up-and-down guide parts 5*d* are formed in the axial direction. By providing the up-and-down guide parts 5*d*, the second rotor 8 described later is disposed outside the first rotor 5 so as to be vertically movable, and is held in engagement with the first rotor 5 so that they can rotate at the same time.

The rotary shaft 5*a* is provided with plural spring storing parts 5*e* in each of which a coiled return spring 7 is stored and upwardly energizes the second rotor 8 at all times. A pair of engagement hooks 5*f* are provided at the upper end of the spring storing part 5*e*, and lock hook engagement parts 8*c* provided at the second rotor 8 described later, thereby preventing the second rotor 8 from being disengaged.

The second rotor 8 is made of an insulating material such as synthetic resin and has a hollow ring-shape area at the center thereof. The second rotor 8 has a large-diameter shaft insertion hole 8*a* that is inserted in the rotary shaft part 5*a* of the first rotor 5 and engaged outside the rotary shaft part 5*a*. Inside the shaft insertion hole 8*a* are formed plural engagement projections 8*b* engaged in the up-and-down guide parts 5*d* provided in the outer circumference of the first rotor 5. The engagement projections 8*b* are disposed so as to be movable vertically along the up-and-down guide parts 5*d*, and rotate at the same time as the first rotor 5 while abutting on the up-and-down guide parts 5*d* when the second rotor 8 is rotated.

Plural hook engagement parts 8*c*, formed on the second rotor 8, engage with the plural engagement hooks 5*f* provided on the first rotor 5, thereby being prevented from disengaging from the rotary shaft part 5*a* of the first rotor 5.

On an inner surface of the second rotor 8 is formed a storing hole 8*d* for storing a steel ball 9 and a coil spring 10, which serve as an elastic member. By storing the elastic member in the storing hole 8*d* and energizing the steel ball 9 with the coil spring 10, the mechanical contact between the storing hole 8*d* and the cam parts 5*c* provided in the outer circumference of the rotary shaft part 5*a* of the first rotor 5 gives a user clicking feeling when the second rotor 8 ascends or descends.

Engagement grooves 8*e* for engaging a rotation operation knob 11 are formed in opposed relation to each other in the outer circumference of the second rotor 8.

A multi-direction operation switch 200, which is a switch enabling deviation along a push direction and four directions by one movably supported part, is disposed in the hollow part of the supporting shaft part 1*a* of the housing 1. The multi-direction operation switch 200 includes a case 21 having an internal storing part (not shown) and a slide member 22 which is movable along an axis of the member 22, and tiltable along four directions in the storing part of the case 21. The case 21 is made of an insulating material such as synthetic resin and formed in box shape. On an inside bottom of the case 21, plural fixed contacts (not shown) made of a conductive metallic material are provided. The plural fixed contacts include a central fixed contact brought into contact, thereby electrically coupled when the slide member 22 is pushed in a push direction, and peripheral fixed contacts brought into contact, thereby electrically coupled in the respective operation directions when the slide member 22 is tilted in four directions.

On the above-described plural fixed contacts, domed movable contacts (not shown) made of a conductive metallic material are respectively provided facing the fixed contacts. The plural movable contacts include a central movable contact pushed and electrically connected to the central fixed contact when the slide member 22 is pushed in a push direction, and peripheral movable contacts pushed and electrically connected to the peripheral fixed contacts when the slide member 22 is tilted in four directions.

The rotary switch 100 and the multi-direction operation switch 200 are integrally fitted to a frame of electronic equipment or the like not shown and the circuit board 50. The hollow rotation operation knob 11 is fitted to the top of the second rotor 8 of the rotary switch 100, and an inclination operation knob 12 fitted in the slide member 22 of the multi-direction operation switch 200 is placed in the center of a hollow area of the rotation operation knob 11, constituting an integral composite operation switch.

An illumination-use LED 13 for displaying the operation function of the inclination operation knob 12 is disposed in the hollow area of the supporting shaft part la of the housing 1.

A detecting switch 300, which is a push switch for driving mechanism, is disposed on the circuit board 50, at a lower portion of and in opposed relation to the second rotor 8 in the vicinity of the housing 1. The detecting switch 300 is configured so that, when a lever 31 is pushed in, an internal contact part not shown is switched for signal switching.

The detecting switch 300 is disposed on the circuit board 50 so that it is operated by the second rotor 8 to which the rotation operation knob 11 is fitted, and outputs a signal corresponding to a vertical movement position of the second rotor 8 to a control circuit not shown, which selects, according to the detection signal, one of types of plural selection functions assigned to the multi-direction operation switch 200.

Namely, when the rotation operation knob 11 is in an upward position, the lever 31 of the detecting switch 300 is also in an upward position, and according to a first detection signal from the detecting switch 300, the multi-direction operation switch 200 is positioned to set a first selection function (e.g., volume switching) of assigned plural selection functions by the control circuit not shown. When the rotation operation knob 11 is pushed in to a downward position, the lever 31 of the detecting switch 300 is pushed in by the second rotor 8, so that the contact part is switched. At this time, a second detection signal is outputted from the detecting switch 300 and a second selection function (e.g., loudspeaker switching) is set by the control circuit not shown.

In this embodiment example, the rotation operation knob 11 is configured to ascend and descend without lock, and a click mechanism is formed between the first and second rotors 5 and 8 to impart tactile feel when ascending and descending.

By providing the detecting switch 300, although the respective switches of the multi-direction operation switch 200 have only a single function, more selection functions, if necessary, can be provided without increasing the number of switches or expanding its size, and the number of switches placed on a plane can be minimized. As a result, there is no fear that malfunction might occur due to the user's mistaken press during selection operation on the switch, so that a composite operation switch is obtained which is excellent in operability during selection operation on the switch.

Figure 7:
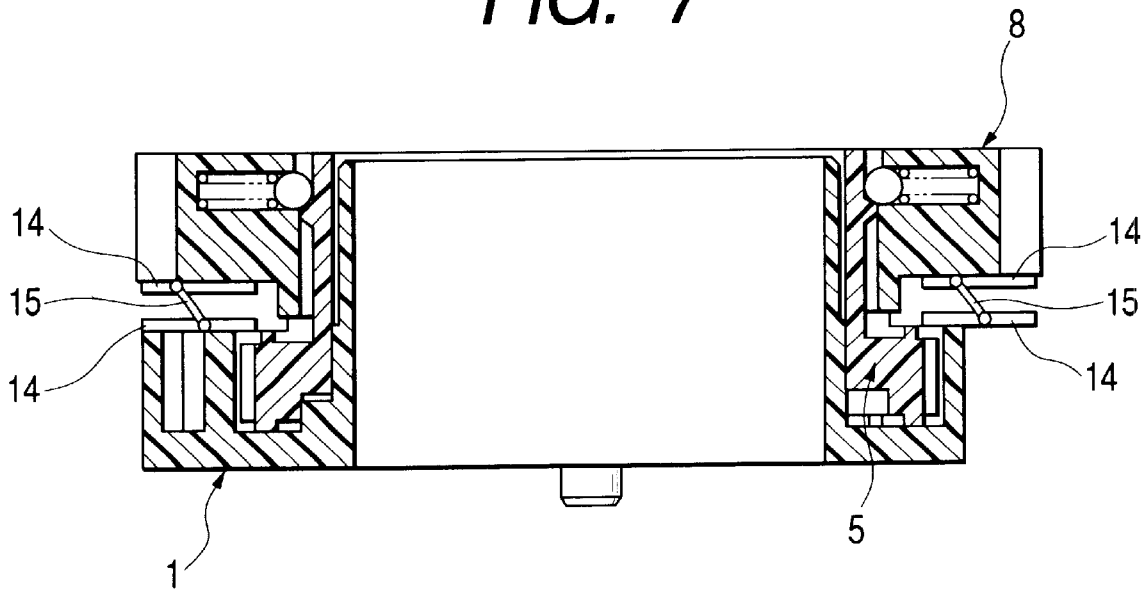
FIG. 7 is a sectional view showing the placement of a parallel link mechanism of the present invention.

FIG. 7 shows the configuration of a parallel link mechanism, which is formed between the first rotor 5 and the second rotor 8 and controls vertical movement of the second rotor 8. The parallel link mechanism includes plural movable links 15 placed at a fixed interval between, e.g., a pair of opposing flat substrates so that the first rotor 5 and the second rotor 8 can ascend and descend in parallel to each other while maintaining an identical interval between them at all times.

By providing the parallel link mechanism, even if the rotation operation knob 11 is pushed at one end thereof, since the second rotor 8 ascends and descends in parallel, the lever 31 of the detecting switch 300 can operate without fail to turn the detecting switch 300 on, so that malfunction can be prevented.

As has been described above, the composite operation switch of the present invention includes: a housing that has a hollow ring-shape area and is provided with a fixed contact on an inside bottom face of the ring-shape area; a first rotor that is rotatably mounted in the housing and provided with movable contacts, which, upon rotation, contact or separate from the fixed contact; a second rotor that is mounted in the first rotor and rotates together with the first rotor; and a multi-direction operation switch placed inside the hollow ring-shape area of the housing, wherein the second rotor is mounted in the first rotor so as to be vertically movable, and in the vicinity of the housing, a detecting switch is provided that detects a vertical movement position of the second rotor and outputs a signal for switching the types of selection functions of the multi-direction operation switch. With this construction, more selection functions of the multi-direction operation switch, if necessary, can be provided without adding switches or increasing its size, and the number of switches placed on a plane can be minimized. As a result, there is no fear that malfunction might occur due to the user's mistaken press during selection operation on the switch, so that a composite operation switch is obtained which is excellent in operability during selection operation on the switch.

The first rotor is provided with up-and-down guide parts engaged with the second rotor; and by the up-and-down guide parts, the second rotor is disposed outside the first rotor so as to be vertically movable, the second rotor is fitted in the first rotor so that they rotate at the same time, and the first and second rotors are integrally mounted rotatably in the housing. With this construction, the selection functions of the multi-direction operation switch can be increased with simple construction.

The first rotor is provided with convex cam parts, the second rotor is provided with elastic members engaging with the convex cam parts, and when the second rotor ascends or descends, the elastic members move across the cam parts. With this construction, tactile feel is obtained when the second rotor ascends or descends.

The parallel link mechanism for controlling vertical movement of the second rotor is provided between the first rotor and the second rotor. With this construction, since the second rotor ascends and descends in parallel, the detecting switch can operate without fail, so that malfunction can be prevented.

Since the multi-direction operation switch is a four-direction inclination switch with a center push switch, an integral composite operation switch having many functions is obtained.

What is claimed is:

1. A composite operation switch, including:

a housing that has a hollow ring-shape area and is provided with fixed contacts on an inside bottom face of the ring-shape area;

a first rotor that is rotatably mounted in the housing and provided with movable contacts, which, upon rotation, contact or separate from the fixed contacts;

a second rotor that is mounted on the first rotor and rotates together with the first rotor; and a multi-direction operation switch placed inside the hollow ring-shape area of the housing, wherein the second rotor is mounted on the first rotor so as to be vertically movable, and in the vicinity of the housing, a detecting switch is provided that detects a vertical movement position of the second rotor and outputs a signal for switching the types of selection functions of the multi-direction operation switch.

2. The composite operation switch according to claim 1, wherein:

the first rotor is provided with up-and-down guide parts engaged with the second rotor; and by the up-and-down guide parts, the second rotor is disposed outside the first rotor so as to be vertically movable, the second rotor is fitted on the first rotor so that they rotate at the same time, and the first and second rotors are mounted rotatably in the housing.

3. The composite operation switch according to claim 1, wherein:

the first rotor is provided with convex cam parts;

the second rotor is provided with elastic members engaging with the convex cam parts; and when the second rotor ascends or descends, the elastic members move across the cam parts.

4. The composite operation switch according to claim 3, wherein a parallel link mechanism for controlling vertical movement of the second rotor is provided between the first rotor and the second rotor.

5. The composite operation switch according to claim 1, wherein the multi-direction operation switch is a four-direction inclination switch with a center push switch.

* * * * *